United States Patent [19]

McConnell et al.

[11] Patent Number: 4,772,002

[45] Date of Patent: Sep. 20, 1988

[54] PREP AND OPERATING STAND

[76] Inventors: Bernard E. McConnell, Route 2, Box 87; Thomas E. McConnell, Route 2, Box 89, both of Greenville, Tex. 75401

[21] Appl. No.: 34,751

[22] Filed: Apr. 6, 1987

[51] Int. Cl.[4] ..... A61G 13/00

[52] U.S. Cl. ..... 269/327; 269/328

[58] Field of Search ..... 269/327, 328, 15, 76; 128/133, 134

[56] References Cited

U.S. PATENT DOCUMENTS

| | | | |
|---|---|---|---|
| 3,386,444 | 6/1968 | Brenner et al. | 269/327 |
| 4,602,773 | 7/1986 | Craven | 269/327 |
| 4,635,913 | 1/1987 | Rothman | 269/327 |
| 4,635,914 | 1/1987 | Kabanek | 269/328 |

*Primary Examiner*—Robert C. Watson

*Attorney, Agent, or Firm*—Dennis T. Griggs

[57] ABSTRACT

A prep and operating stand is provided for use by orthopedic surgeons for supporting and positioning a limb for surgery, for holding a collection bag underneath the limb during preparation, and for holding a tray of surgical instruments during an operating procedure. A first hoop-shaped frame is supported by an adjustable leg structure at one end and by a pivoted linkage attached to a surgical table at the other end. The hoop-shaped frame can optionally be provided with collection bag supporting structure or with tray supporting structure. The stand is collapsible for compact storage after use.

14 Claims, 4 Drawing Sheets

PREP AND OPERATING STAND

TECHNICAL FIELD

This invention pertains to surgical equipment, and more particularly to a stand for preparing a limb for surgery being attachable to an operating table and having means for supporting the limb, means for retaining a bag underneath the limb, and means for holding a tray including surgical instruments.

BACKGROUND ART

Orthopedic surgery, more than any other surgical discipline, places stringent demands on the surgeon and his assistant for precision in approach, positioning, and support of the limb under operation. The need for safe, sterile, and stable positioning and support of joints and extremities during major orthopedic surgical procedures is therefore of primary concern to practitioners in this field.

A number of positioning systems for attachment to surgical tables have been used for positioning and support during surgery. In general, these systems include a variety of adjustable arms, slings and support pads attachable to the table. In addition, it is known to provide a hoop for attaching a collection bag below a sling to collect fluids resulting from irrigation while "prepping" the limb for surgery.

SUMMARY OF THE INVENTION

The present invention provides a prep and operating stand for use by orthopedic surgeons and their assistants that incorporates in a single device a sling for supporting and positioning a limb for surgery, structure for holding a collection bag and structure for holding a tray of surgical instruments. In the preferred embodiment, a first hoop-shaped frame for holding a sling is supported by a leg structure at one end and by a pivoted linkage for attachment to a surgical table at the other end. A removable, second hoop-shaped frame is provided for supporting a collection bag while prepping the limb for surgery. Once preparation is complete, the frame supporting the bag can be removed from the stand and a tray of operating instruments may be placed in the first frame. The entire apparatus is collapsible for storage when not in use.

BRIEF DESCRIPTION OF THE DRAWINGS

A more complete understanding of the invention and its advantages will be apparent from the Detailed Description taken in conjunction with the accompanying Drawings in which.

DETAILED DESCRIPTION OF THE PREFERRED EMBODIMENT

Figure 1:
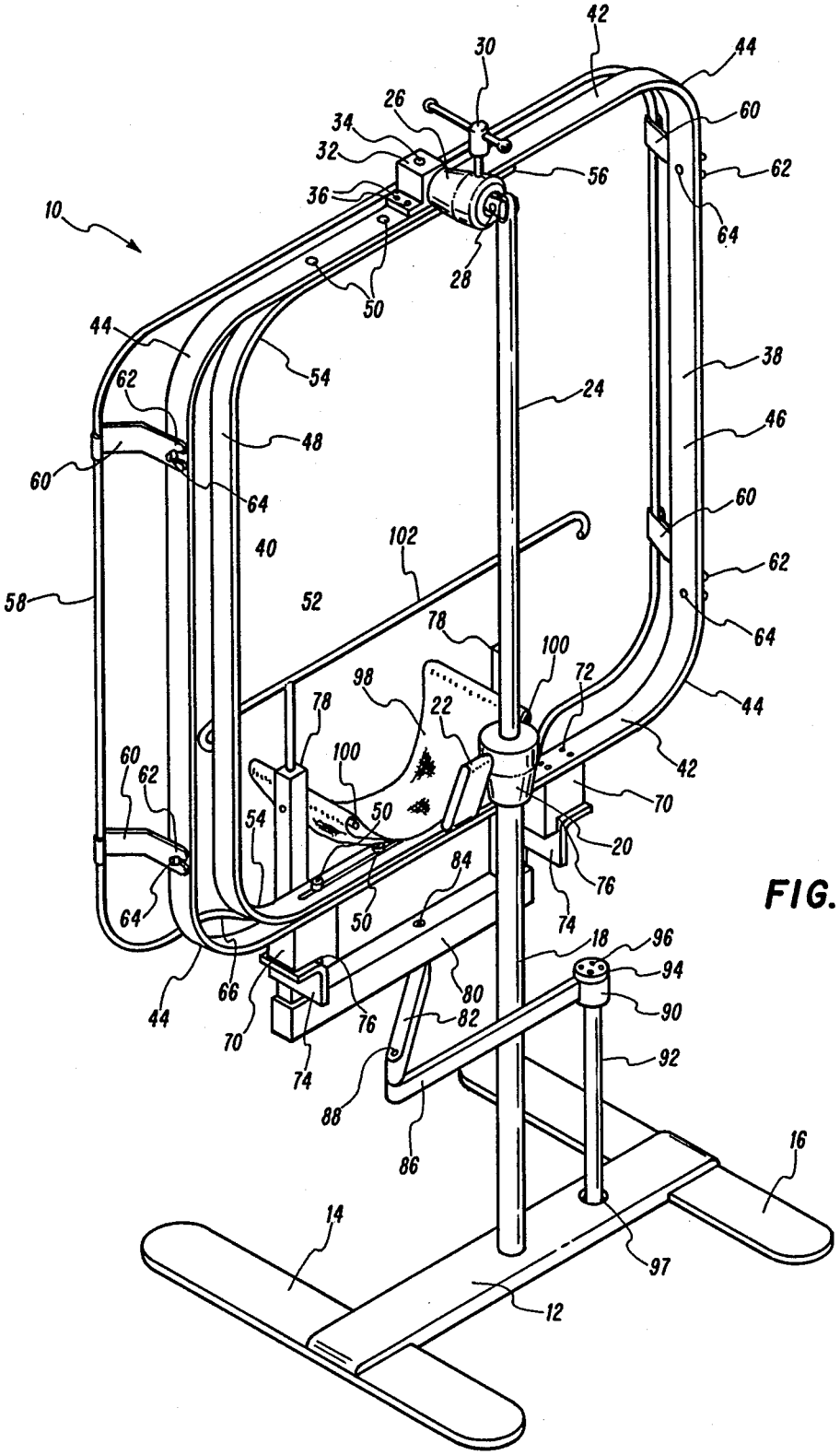
FIG. 1 is a perspective view of the prep and operating stand of the present invention.
Figure 2A:
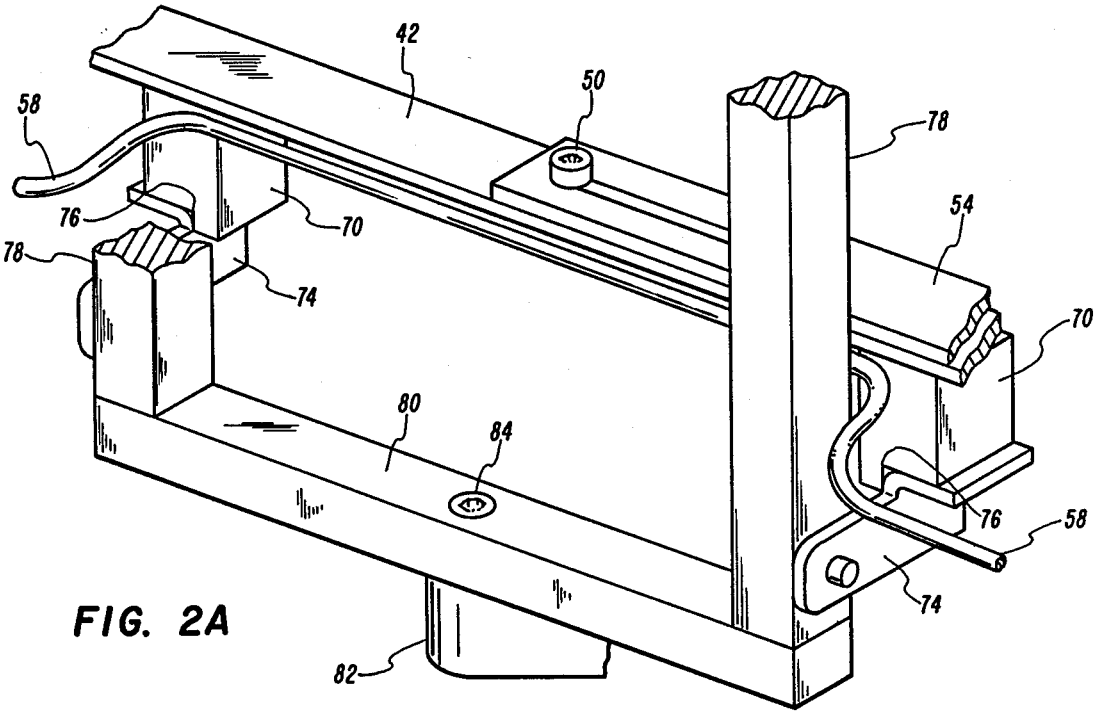
FIGS. 2A and 2B are detailed perspective views of the sling support of the stand of FIG. 1.
Figure 2B:
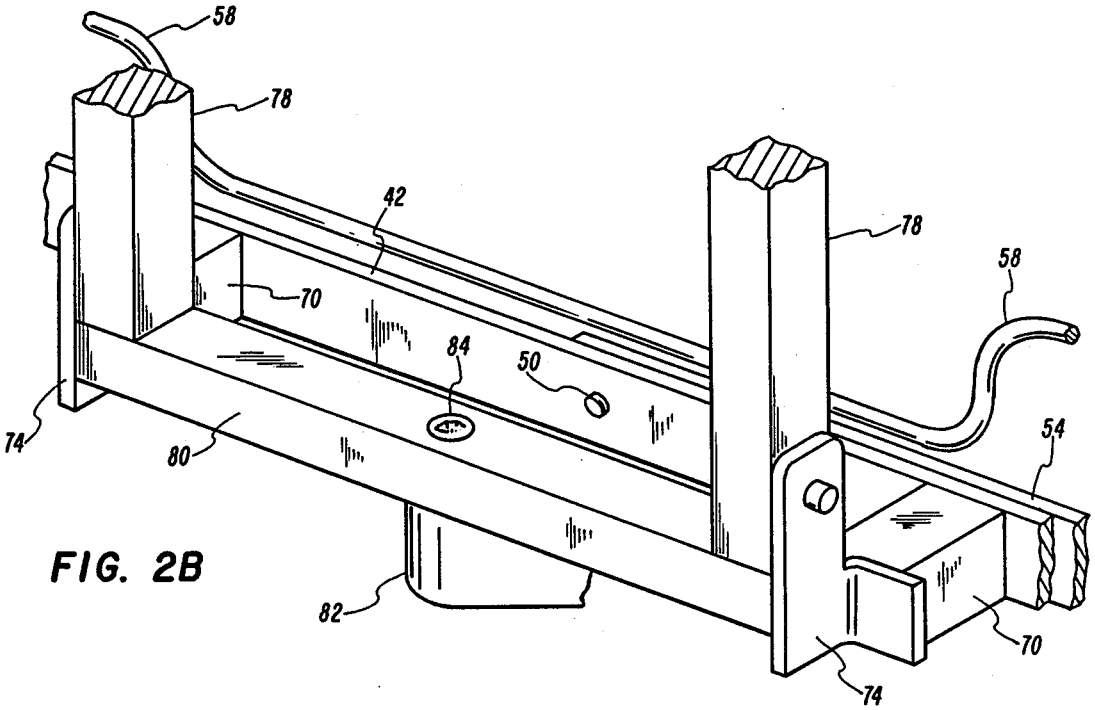

Referring initially to FIGS. 1, 2A and 2B, stand 10 includes base 12 supported by pads 14 and 16 for supporting the stand. Tube 18 is rigidly connected to base 12 at the lower extremity thereof. Collar 20 is attached to the upper end of tube 18 and includes a handle 22 for clamping rod 24 with respect to tube 18. Rod 24 is restrained for telescoping movements with respect to tube 18 and is lockable by way of handle 22 at any desired position. A similar collar 26 is connected to the top of rod 24 by way of a clevis member 28. Clevis member 28 allows collar 26 to be swiveled from the position shown in FIG. 1 to a fully upright position. A handle 30 is provided to clamp clevis member 28 within collar 26.

Clevis member 28 extends through collar 26 and engages support 32 at its opposite end. Set screw 34 locks clevis member 28 within support 32. Support 32 is attached by way of screws 36 to a first hoop-shaped main frame 38. In preferred form, main frame 38 is a rectangular member having long sides 40 and short sides 42 joined by rounded corners 44, and is manufactured from a ribbon of aluminum alloy approximately one inch high and threesixteenths of an inch thick. Inner frame member 48 is connected for sliding engagement with main frame 38 by means of screws 50. Inner frame member 48 has a long side 52 and rounded corners 54 being of slightly smaller dimensions than long sides 40 and corners 44 of main frame 38. Inner frame member 48 is a three-sided structure, terminating at ends 56, one of which is shown in FIG. 1. Inner frame member 48 provides an adjustable inner dimension such that a conventional surgical tray ("Mayo tray") may be supported by stand 10. A removable hoop-shaped bag support frame 58 is attached to main frame 38 by way of four supports 60. Each support 60 includes a slot 62 for engagement with a screw 64 in main frame 38. In the preferred embodiment, bag support frame 58 is manufactured from quarter-inch aluminum alloy tubing and includes an offset portion 66 on its side opposite collar 26.

Blocks 70 extend from the short side 42 of main frame 38 opposite collar 26 and are fastened thereto by way of screws 72. Hinges 74 are in turn fastened to blocks 70 in an inter-fitting relationship provided by a notch 76 in each block 70. Sling arms 78 are pivotally mounted in hinges 74 such that they may rotate ninety degrees with respect to hinges 74 from the position shown in FIGS. 1 and 2A to the position shown in FIG. 2B. Crossbar 80 is fastened to and spans between sling arms 78. Link 82 is pivotally connected to crossbar 80 at pivot point 84, and link 86 is pivotally connected to link 82 at pivot point 88. Pivot points 84 and 88 preferably include a steel pin passing through a bronze bushing. Head 90 is attached to link 86 at the end opposite pivot point 88. A cylindrical rod 92 is rotatably mounted in head 90, and cap 94 is fastened to head 90 by way of screws 96. A hole 97 is provided in base 12 for engagement with rod 92, as shown in FIG. 1. Sling arms 78 support sling 98 by way of sling supports 100 rotatably attached to the ends of sling arms 78 opposite hinges 74. A removable splash guard frame 102 extends from the extreme ends of sling arms 78.

Figure 3:
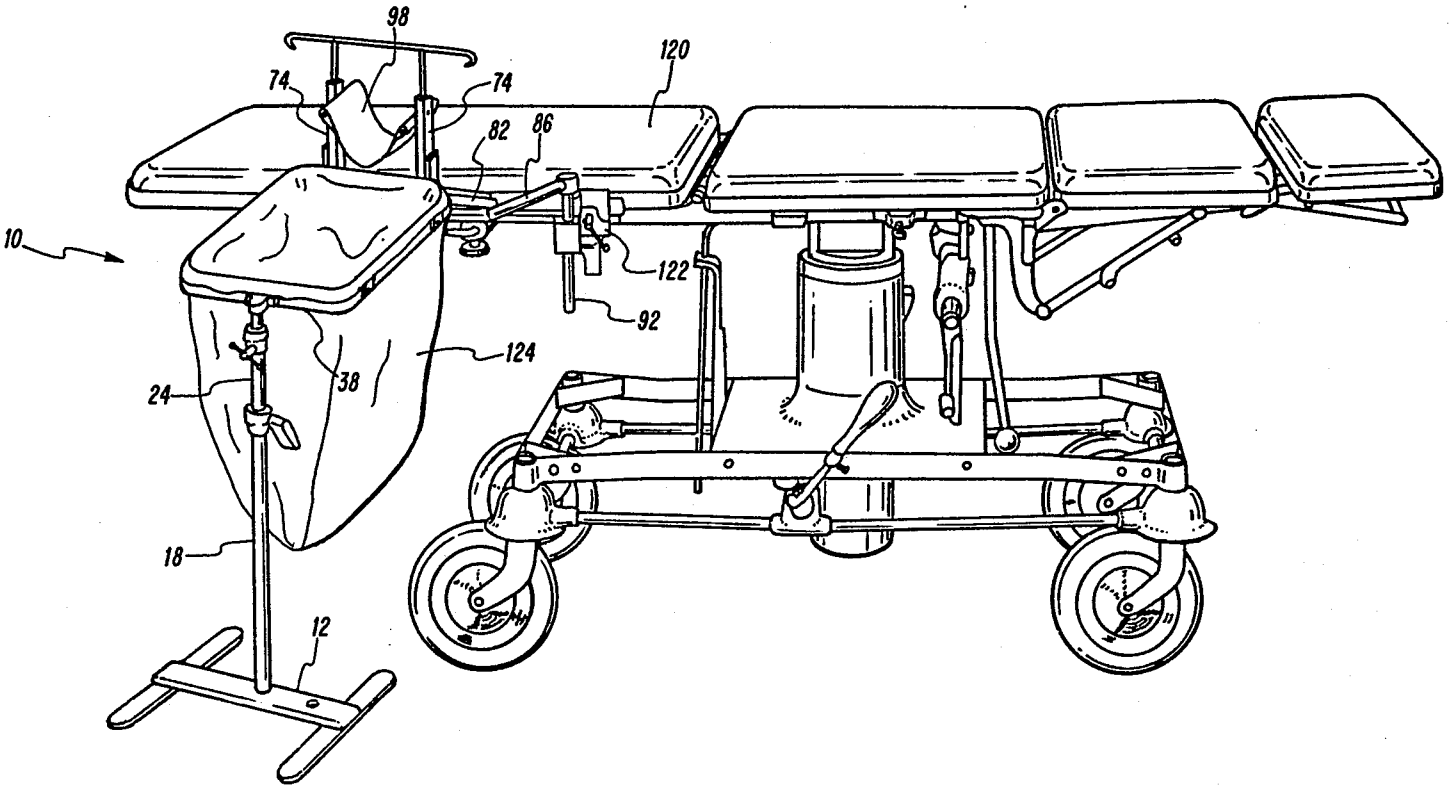
FIG. 3 illustrates the stand of FIG. 1 connected to an operating table and being used to support a collection bag.
Figure 4:
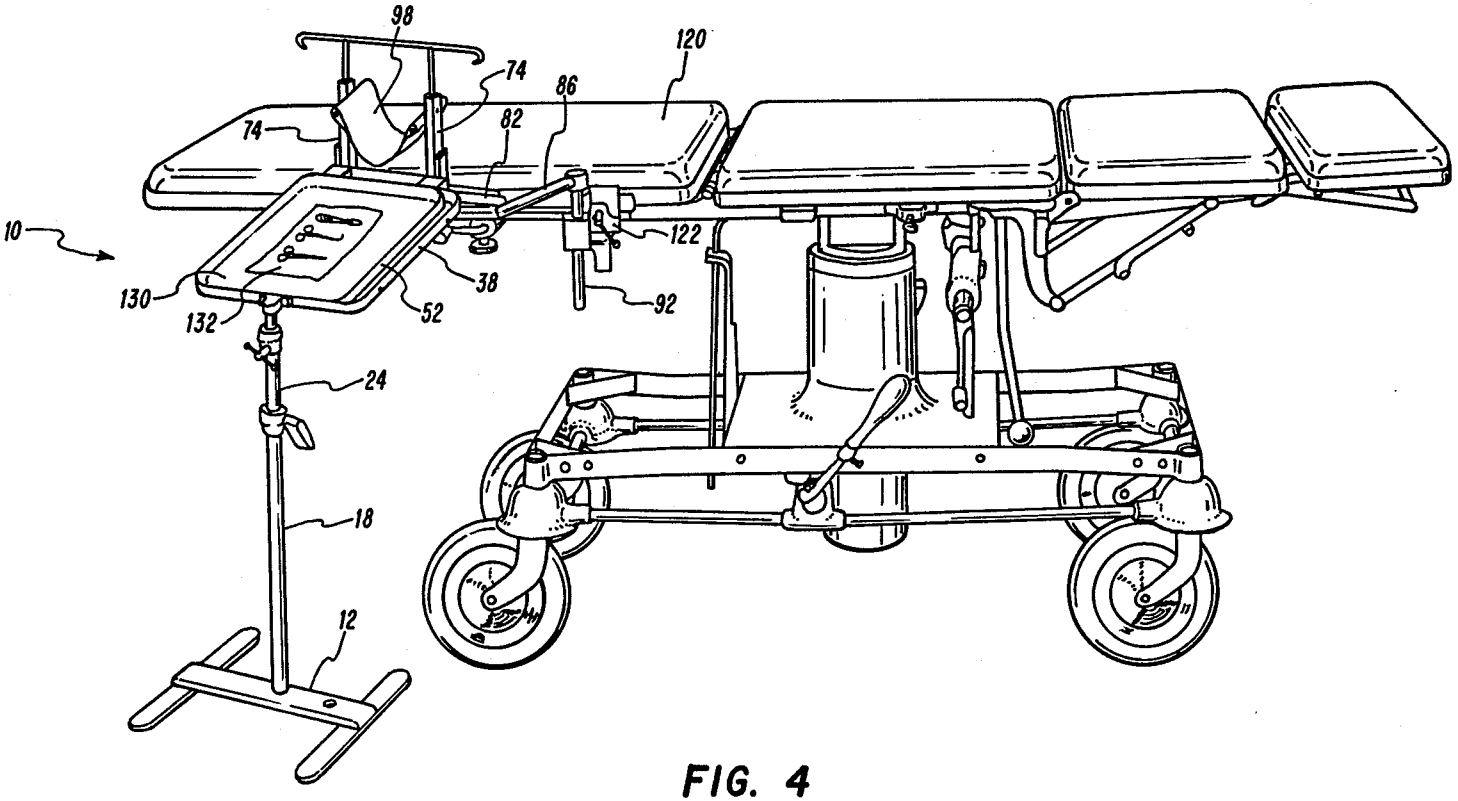
FIG. 4 is a view similar to FIG. 3 in which the collection bag support has been removed and the stand is used to support a tray of operating instruments.

Referring now to FIGS. 3 and 4, in operation, the prep and operating stand 10 is attached to surgical table 120 by engaging rod 92 with an adjustable clamp 122 attached to a side of table 120. Rod 24 is clamped with respect to tube 18, and rod 92 is clamped with respect to clamp 122, to maintain main frame 38 in a horizontal orientation and at a particular desired height. Once the height of main frame 38 is established, the distance between stand 10 and table 120 as well as the angle between them is readily adjustable by simply moving the stand, due to the rotatable mounting of links 82 and 86. Links 82 and 86 provide vertical support for one side of main frame 38, but the entire stand 10 is freely movable in a horizontal plane to permit adjustments in position and angle of the stand with respect to the table. Sling arms 78 are rotated in hinges 74 such that they are perpendicular with main frame 38. A limb may then be placed in sling 98 extending over collection bag 124 held by bag support frame 58 for preparation. Spent materials used in preparing the limb for surgery as well as fluid run-off from irrigation are collected in collection bag 124 for disposal.

After preparation of the limb is completed, bag 124 and bag support frame 58 are removed from main frame 38 and a tray 130 is placed on stand 10, as shown in FIG. 4. Surgical instruments 132 are placed on tray 130 for easy access during the surgical procedure. The position of inner frame member 48 within main frame 38 is preset to accommodate the particular size of tray 130 to be used in the procedure.

It can thus be seen that stand 10 supports and positions the limb for surgery by way of sling 98 supported by main frame 38, which in turn is securely supported by the telescoping rod 24 in tube 18 supported by base 12 on one side and the pivoted links 82 and 86 attached to table 120. The limb extends over the area defined by main frame 38, which optionally supports either the collection bag 124 with its removable support frame or a tray 130 bearing the equipment and instruments to be used in the surgery. The stand is vertically supported by the leg structure comprising rod 24, tube 18 and base 12 and the linkage comprising links 82 and 86, but horizontal and angular positioning with respect to the table is always available. The main frame 38 and sling arms 78 are rotatable about their supports for collapsing the stand after use to enable compact storage.

Whereas the present invention has been described with respect to a specific embodiment thereof, it will be understood that various changes and modifications will be suggested to one skilled in the art and it is intended to encompass such changes and modifications as followed in the scope of the appended claims.

What is claimed is:

1. A prep and operating stand comprising:

a free-standing vertical leg connected to a base adapted for stable engagement with the floor;

an open main frame attached at a first peripheral portion thereof to an upper portion of the leg;

a support link connected at one end to a second peripheral portion of the main frame;

means disposed at the other end of the support link for connecting the link to an operating table;

means attached to the main frame for supporting and positioning a limb of a patient lying on the operating table over the main frame; and, means attached to the main frame for supporting an open collection bag adjacent to and at a lower elevation than the means for supporting and positioning a limb.

2. The apparatus of claim 1 wherein the means for supporting a collection bag is removable.

3. The apparatus of claim 2 wherein the means for supporting a collection bag is removably attached in a spaced apart relationship to the main frame.

4. The apparatus of claim 1 wherein the means for supporting a limb includes sling supported by two arms extending upwardly from the main frame.

5. Surgical apparatus comprising:

a hoop-shaped horizontal main frame;

a vertical leg connected to the periphery of the main frame at one end and to a ground-contacting base at the other end;

linkage connected to the periphery of the main frame opposite the leg and adapted for attachment to an adjacent surgical table;

arms connected to the main frame adjacent the linkage, the arms extending vertically from the main frame to sling connection structure; and the main frame including means for holding an open collection bag adjacent the arms.

6. The apparatus of claim 5 wherein the main frame is pivotally mounted to the leg for rotation to a vertical, stowed position.

7. The apparatus of claim 5 wherein the main frame is rectangular and includes means for holding a tray adjacent the arms.

8. The apparatus of claim 5 wherein the height of the leg is adjustable.

9. The apparatus of claim 6 wherein the arms are pivotally mounted to the main frame for rotation to a vertical, stowed position when the main frame is in its stowed position.

10. The apparatus of claim 5 wherein the linkage comprises a plurality of pivoted links attached to the main frame by way of connecting structure for the arms.

11. The apparatus of claim 5 further comprising a removable hoop-shaped bag support frame attached to the main frame.

12. Apparatus, comprising:

a base;

a first leg member extending upwardly from the base to an upper end;

a collar fixed to the upper end of the first leg member and having a releasable clamp;

a second leg member retained by the collar for telescoping movement with respect to the first leg member and having an upper end;

a rectangular hoop-shaped main frame pivotally connected to the upper end of the second leg member for angular movements with respect to the second leg member, the main frame having two long sides and two short sides and being connected to the second leg member at approximately at the midpoint of one of the short sides;

the main frame being pivotable with respect to the first and second leg members between a vertical storage position and horizontal in-use position;

a rectangular hoop-shaped collection bag support frame removably mounted in a spaced apart relationship to the main frame;

a tray frame member mounted within the main frame for slidable movements with respect to the main frame;

a sling support pivotally mounted to the short side of the main frame opposite the short side connected to the second leg member, the sling support including two upstanding arms and a transverse crossbar, the transverse crossbar spanning the upstanding arms at the lower ends thereof, the sling support being pivotable with respect to the main frame between a storage position where the upright arms are vertical when the main frame is in its storage position and an in-use position where the upright arms are vertical when the main frame is in its in-use position;

a sling spanning the upper ends of the upright arms;

a pivotable link attached to one end to a medial portion of the transverse crossbar and extendable outwardly from the main frame; and a pivot member on the other end of the link for pivotable attachment to a table.

13. A prep and operating stand comprising:

a free-standing vertical leg connected to a base adapted for stable engagement with the floor;

an open main frame attached at a first peripheral portion thereof to an upper portion of the leg;

a support link connected at one end to a second peripheral portion of the main frame;

means disposed at the other end of the support link for connecting the link to an operating table;

means attached to the main frame for supporting and positioning a limb of a patient lying on the operating table over the main frame; and, means attached to the main frame for supporting a tray adjacent to and at a lower elevation than the means for positioning and supporting a limb.

14. A prep and operating stand as defined in claim 13, said tray support means comprising:

an open tray frame mounted onto and within the main frame.

* * * * *